US011473861B2

(12) United States Patent
Hegyeshalmi

(10) Patent No.: US 11,473,861 B2
(45) Date of Patent: Oct. 18, 2022

(54) RECOILLESS, SLIDELESS REPEATING MAGAZINE-FED WEAPON

(71) Applicant: Zsolt Hegyeshalmi, Miskolc (HU)

(72) Inventor: Zsolt Hegyeshalmi, Miskolc (HU)

( * ) Notice: Subject to any disclaimer, the term of this patent is extended or adjusted under 35 U.S.C. 154(b) by 0 days.

(21) Appl. No.: 17/053,468

(22) PCT Filed: Jun. 1, 2018

(86) PCT No.: PCT/HU2018/000023

§ 371 (c)(1),
(2) Date: Nov. 6, 2020

(87) PCT Pub. No.: WO2019/215462

PCT Pub. Date: Nov. 14, 2019

(65) Prior Publication Data

US 2021/0239413 A1 Aug. 5, 2021

(30) Foreign Application Priority Data

May 8, 2018 (HU) ..... U1800070

(51) Int. Cl.

| | |
|---|---|
| ***F41A 1/08*** | (2006.01) |
| ***F41A 9/55*** | (2006.01) |
| ***F41A 9/65*** | (2006.01) |
| *F41A 3/72* | (2006.01) |
| *F41C 7/02* | (2006.01) |

(52) U.S. Cl.
CPC ..... *F41A 1/08* (2013.01); *F41A 9/55* (2013.01); *F41A 9/65* (2013.01); *F41A 3/72* (2013.01); *F41C 7/02* (2013.01)

(58) Field of Classification Search
CPC .. F41A 1/08; F41A 19/14; F41A 19/42; F41A 15/18; F41C 7/02
See application file for complete search history.

(56) References Cited

U.S. PATENT DOCUMENTS

| | | | | |
|---|---|---|---|---|
| 1,280,579 A * | 10/1918 | Stone et al. | ..... | F41A 1/10 89/1.7 |
| 2,889,747 A * | 6/1959 | Kamp | ..... | F41A 9/45 89/1.704 |
| 2,984,156 A * | 5/1961 | Gunnar | ..... | F41A 1/08 89/1.705 |
| 3,399,597 A * | 9/1968 | Perrine | ..... | F41A 21/30 89/14.4 |

(Continued)

FOREIGN PATENT DOCUMENTS

GB 645751 A 11/1950

*Primary Examiner* — Derrick R Morgan
(74) *Attorney, Agent, or Firm* — Olson & Cepuritis, Ltd.

(57) ABSTRACT

A recoilless, slideless repeating magazine-fed (19) weapon, comprising a hammer (9), a hammer pull rod (7), a trigger spring (8) and a safety (28). The open breech (15) connects directly to the open, expanding cross-section funnel (18), and furthermore the funnel (18) has an extractor (24) on the side which connects to the forend (21) through a funnel pull rod (20), and furthermore the magazine (19) is connected to the magazine well (19/1) at the bottom of the open breech (15) with a magazine holding pin (19/6). The weapon is compatible with a variety of magazines (19), including box magazines (with one or more rows of cartridges), drum magazines, or helical magazines.

6 Claims, 7 Drawing Sheets

(56) References Cited

U.S. PATENT DOCUMENTS

Figure 1:
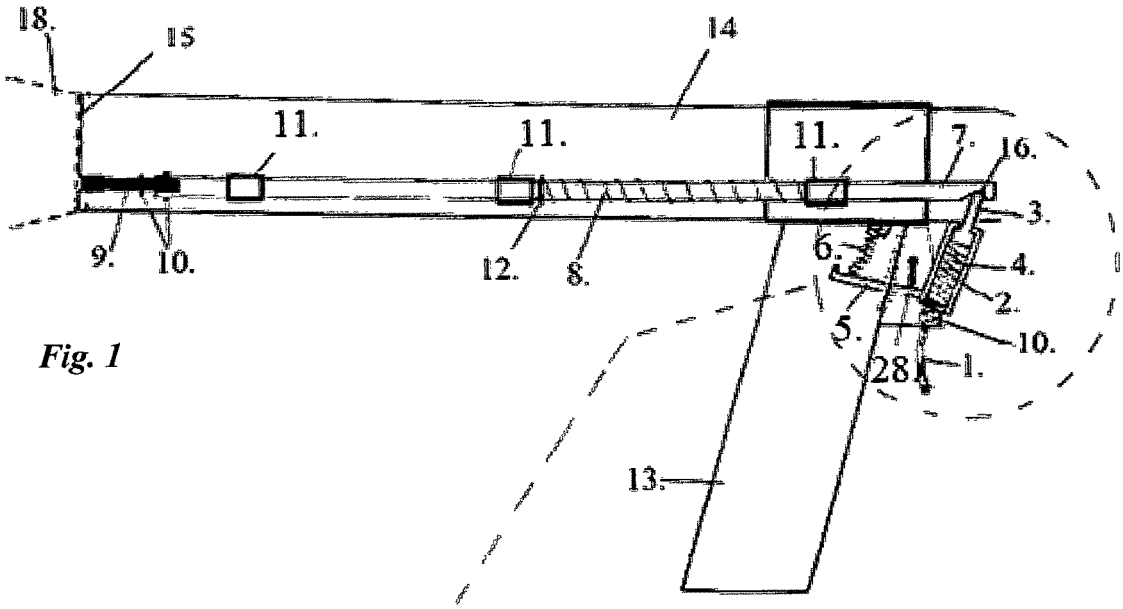

| | | | | | |
|---|---|---|---|---|---|
| 3,444,778 | A * | 5/1969 | Bates | F41F 3/0455 | 42/105 |
| 3,677,131 | A * | 7/1972 | Nee | F41A 1/08 | 244/3.28 |
| 3,745,876 | A * | 7/1973 | Rocha | F41F 3/077 | 89/1.816 |
| 3,999,460 | A * | 12/1976 | Skliris | F41A 19/69 | 89/1.804 |
| 4,019,423 | A * | 4/1977 | Johnson | F41A 3/62 | 89/197 |
| 4,128,039 | A * | 12/1978 | Skliris | F41A 9/27 | 89/1.804 |
| 4,404,887 | A * | 9/1983 | Piesik | F41A 1/08 | 89/1.816 |
| 4,577,813 | A * | 3/1986 | Romer | F42B 12/14 | 102/476 |
| 4,593,602 | A * | 6/1986 | Faix | F41A 19/27 | 89/27.13 |
| 4,843,946 | A * | 7/1989 | Gladstone | F41A 21/02 | 89/1.7 |
| 6,412,614 | B1 | 7/2002 | Lagrange et al. | | |
| 7,261,029 | B1 | 8/2007 | Davis | | |
| 2021/0048261 | A1* | 2/2021 | Muska | F41C 7/02 | |

* cited by examiner

RECOILLESS, SLIDELESS REPEATING MAGAZINE-FED WEAPON

The subject of this patent is a recoilless/slideless repeating magazine-fed weapon. A primary aspect of the weapon is the use of an open breech, allowing the generated gases to freely leave the weapon, which can then be reloaded from the magazine via the forend rail. This design is also slideless, because there are no moving parts during firing, or while ejecting the round.

Recoil and sliding are general mechanical phenomena occurring due to the method of operation for various weapons. While slideless weapons do exist, including e.g. shoulder-mounted RPG/Carl Gustav weapons, these do not have magazines. There were a number of previously patented inventions attempting to find a solution to this problem, primarily focusing on reducing recoil. One such invention is U.S. Pat. No. 7,261,029, "FIREARM BOLT LOCKING MECHANISM", which describes a design where the magazine also includes the pressure spring, the feed block, and the bullets. This utility model is a slideless weapon, with the feed block itself blocking the breech (an open breech, in our case), once the magazine is empty, as is the case e.g. for the PA63's front slide rail. With our feed block design (longitudinal milling), this element becomes unnecessary, making reloading simpler, as the breech does not need to slide back to remove the magazine. Once the magazine is replaced, the ammunition can be chambered with a single chambering motion. Another solution proposing to reduce recoil is U.S. Pat. No. 6,412,614, "DOWNHOLE SHOCK ABSORBER", which uses a shock absorber device that is activated while firing. This solution is not relevant for our design, as we completely eliminate sliding and recoil: thus, reloading is the only time any part of the weapon slides back. Overall, it is clear that none of the existing inventions is capable of eliminating the sliding/recoil of magazine-fed weapons, only for weapons without magazines. For example, the funnel of an RPG is fixed to the breech and not movable, but even the funnel of a Carl Gustav can only be moved by first rotating it upwards and to the left, then removing the spent casing by hand, and finally loading the new cartridge into the barrel. The cartridge is locked by rotating the funnel back, and the weapon is then ready for firing once more. Recoil occurs for most weapons because the breech behind the cartridge is blocked. Thus, when the weapon is fired and the gunpowder in the cartridge combusts, the released gas pressure propels the bullet forward, out of the barrel in the direction of firing. However, the gas pressure also acts in the opposite direction, towards the blocked breech. As a result, the weapon also pushes backwards on the user. This happens for other types of repeating, semi-automatic and automatic weapons. This invention aims to correct the deficiencies of the existing inventions, and to eliminate the aforementioned issue/phenomenon for high-caliber magazine-loaded weapons.

The primary goal of the invention is to eliminate weapon recoil when firing. This is achieved by using an open breech and having the weakly attached cartridge base tear off and propel backwards on firing. Thus, when the weapon is fired, the created gas pressure propels the bullet forward, while the cartridge base is ejected backwards, through the open breech. Thus, the lack of recoil is achieved via the unobstructed release of pressure and ejection of the cartridge base through the completely open (unblocked) breech behind the cartridge. This means that the gas pressure created through the combustion of the gunpowder can freely escape backwards and will therefore not exert any backwards force on the weapon or its user. This is important because while a weapon's user can handle the recoil caused by the gas pressure of small-caliber cartridges without injury, these bullets are wholly inadequate for the purposes that higher-caliber cartridges are used for. On the other hand, these high-caliber cartridges have much more gunpowder and a larger bullet, meaning that a blocked breech would result in recoil that would make handling the weapon impossible, and could cause the user serious (possibly even fatal) injuries. This larger (over 30 mm) caliber of ammunition is necessary for certain purposes—penetrating armor or building walls, disabling vehicles—and recoil must therefore be eliminated to ensure that the weapon can be handled without injury to the user.

The rear of the weapon's barrel (the breech), where the cartridge is located, is completely open (unblocked) in our design. Effectively, this means that when the weapon is unloaded and there is no cartridge in the barrel, it is possible to see through the entire barrel from either side (as if looking through an empty tube). This is what allows the gas pressure to escape, and how this design is able to eliminate recoil, much like the aforementioned RPG or Carl Gustav. In our design, the breech remains open even when a round is chambered, just like the funnel adjacent to it. Two grooves are visible on the breech. The bottom groove is necessary for the hammer to be able to hit the primer around the cartridge when firing. The top groove is for the extractor catching the rim/groove of the cartridge when chambering.

The funnel is set against the open breech and is a movable part in our design. In addition to its other characteristics as described later in this document, its primary function is chambering the cartridge, and keeping it in the barrel. Its conical, funnel shape is necessary to ensure that the high-pressure gas from the gunpowder's ignition can freely exit the weapon. By distributing the escaping gas evenly, in several directions, it is possible to reduce the vertical and horizontal movement of the weapon's barrel, thereby allowing for more precise aiming. While this allows the gas to freely exit the back of the weapon, the resultant air pressure could affect objects or living things behind the weapon, which is why it is important to disperse and mitigate the pressure as soon as possible.

The design for the present invention allows the funnel to move back and forth, by pulling the forend rail back, and pushing it forward. This chambers a new cartridge from the magazine into the weapon. The funnel is connected to the sliding forend rail, the funnel holds the cartridge in the open (unblocked) breech, and the funnel pushes the cartridge from the magazine into the breech. The funnel is also completely open (unblocked). The loading pin on the bottom of the funnel is set against the base of the cartridge. This, by pushing the forend rail forward, the funnel it's connected to will push the cartridge from the magazine into the breech. The extractor is at the front side of the funnel positioned against the breech. Its purpose is to hook into the rim/groove of the cartridge chambered into the barrel after firing and during ejection/repeating and draw it out of the barrel. Thus, the barrel is emptied, and a new cartridge can be chambered from the magazine. A tension spring (extractor tension spring) allows the extractor to hook into the rim/groove of the cartridge, as is the case for most repeating weapons.

The magazine is also an innovative feature. While other recoilless weapons are single-action, the magazine makes a repeating weapon possible. By pulling the forend rail backwards and pushing it forwards, a new cartridge can be chambered, meaning that cartridges do not have to be placed or removed by hand every time the weapon is fired. This makes chambering the weapon much faster. The currently existing recoilless weapons (RPG; Carl Gustav) are incapable of repeated chambering/fire at a similar speed, not even if a second person is specifically assigned to reload the weapon. In addition, the weapon's user can carry multiple magazines, meaning many more cartridges, without an assistant, making the use of the weapon far more efficient.

This invention allows the funnel to move back and forth, by pulling the forend rail back, and pushing it forward. This chambers a new cartridge from the magazine into the weapon. The funnel is connected to the sliding forend rail, the funnel holds the cartridge in the open (unblocked) breech, and the funnel pushes the cartridge from the magazine into the breech. The funnel is also completely open (unblocked). The loading pin on the bottom of the funnel is set against the base of the cartridge. This, by pushing the forend rail forward, the funnel it's connected to will push the cartridge from the magazine into the breech. The extractor is at the front side of the funnel positioned against the breech. Its purpose is to hook into the rim/groove of the cartridge chambered into the barrel after firing and during ejection/repeating and draw it out of the barrel. Thus, the barrel is emptied, and a new cartridge can be chambered from the magazine. A tension spring (extractor tension spring) allows the extractor to hook into the rim/groove of the cartridge, as is the case for most repeating weapons.

The function of the magazine is that it contains multiple cartridges, therefore by attaching it to the weapon, it becomes a repeating rifle, as it is no longer necessary to load new cartridges and remove the spent ones by hand. The reason the magazine is an innovative element here is because magazines—or repeating firing systems—have never before been used for recoilless weapons.

The magazine used can be a box, drum, or helical magazine. This would also depend on the various types and calibers of cartridges used. For the invention, it connects to the weapon as follows: the magazine holding pin attaches to the magazine well located at the bottom of the breech and can be attached or removed by using the magazine holding/release button (which operates similarly to the extractor). The magazine holding pin is located on the front of the magazine. This is necessary because the funnel is conical in shape and can be moved backwards. This means that when closed, the back of the funnel is lower than its front, which is in the same plane as the breech. Therefore, the magazine must be placed lower, to allow the funnel to be flush against the breech. This is why the magazine holding pin sticks out of the front of the magazine diagonally upwards, then bends horizontally. The front, horizontally bent section of the magazine holding pin fits into the magazine well at the bottom of the breech. The back, diagonally upward-oriented section of the magazine holding pin also functions as a feeder/positioner, as it forces the magazine into position well below the bottom plane of the breech, due to the conical shape of the funnel, widening as it extends backwards. This is the reason why the front of the funnel (the part set against the breech) needs a loading pin at the bottom, so that it can reach the base of the cartridge below, enabling the chambering of the weapon during loading. This is when the diagonally upwards-oriented section of the magazine holding pin comes into play to position the cartridge, as the front of the cartridge follows its path upward until it meets the plane of the barrel, thereby chambering the cartridge. This diagonally upwards-oriented section of the magazine holding pin has a longitudinal groove (funnel pin well), for the loading pin at the front of the funnel. This prevents it from getting caught in the magazine holding pin, and the funnel can slide forward all the way, until it is fully flush with the breech. The front, horizontal section of the magazine holding pin has a groove for the magazine holding/release button or latch. This keeps the magazine holding pin inside the magazine well, keeping the entire magazine in position.

Most semi-automatic, self-loading or automatic rifles have moving parts even while the fired bullet is still in the barrel. This is because they use the gas pressure to reload, to keep tension on the firing mechanism, and to eject the spent cartridge shell, meaning that they have parts sliding back while firing.

The invention is designed to only have parts moving during reloading and before firing, when pressure is placed on the firing mechanism. There are no longer any moving parts once the primer is struck and the gunpowder ignites; or while the fired bullet is still in the barrel. Even immediately before and after, the parts only move if the user decides to move them himself. This is what makes the design slideless, much like all other non-self-loading (and non-automatic) repeating weapons, including rotary action hunting rifles or old combat rifles, e.g. Mauser M98 (which is actually also slideless, but is not recoilless). For slideless weapons, not even the hammer is moving at the moment of firing (the ignition of the primer).

This means that gas pressure does not build up for the invention, because it is able to escape freely through the open breech. This, in turn, means no recoil, which is also the reason why there are no moving parts either before or during firing. In other words, our design is both slideless and recoilless, while still being magazine-loaded.

For weapons with forend rails, the front grip and the rods are connected to the weapon's action (the action of a weapon is the mechanism that holds the cartridge in the barrel during firing, for this weapon the action would be the open funnel.)

The same is essentially true for our weapon as well, except after chambering, the breech and the funnel both remain open (unblocked).

In this case, the forend rail, which is connected to the funnel, acts only to push the cartridge into place. To actually keep the cartridge loaded into the barrel in place, we use a strong tension spring (lock spring), located between the forend (foregrip) and the fixed rear grip (which also serves to operate the firing mechanism.) This spring could also surround the barrel or could be drawn along rods. In addition, the spring makes it easier to push the forend rail forward, thereby assisting with the chambering of the cartridge. Other types of actions could also be used, but as the high-pressure gas flows freely out the back of the weapon through the funnel and does not put pressure on any part of the weapon, the use of an action is not necessary.

If the rods connected to the funnel were attached to a bolt further back, instead of to the forend, the user would have to let go of the front grip to reload the weapon. This would take additional time and would then require re-orienting the weapon to aim once more.

Other advantages of this design include the forend rail being connected to the breech, and the trigger being connected to the hammer with a tension-rod.

Figure 2:
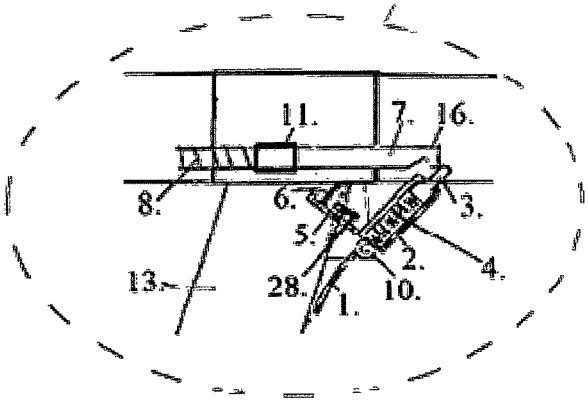
Figure 3:
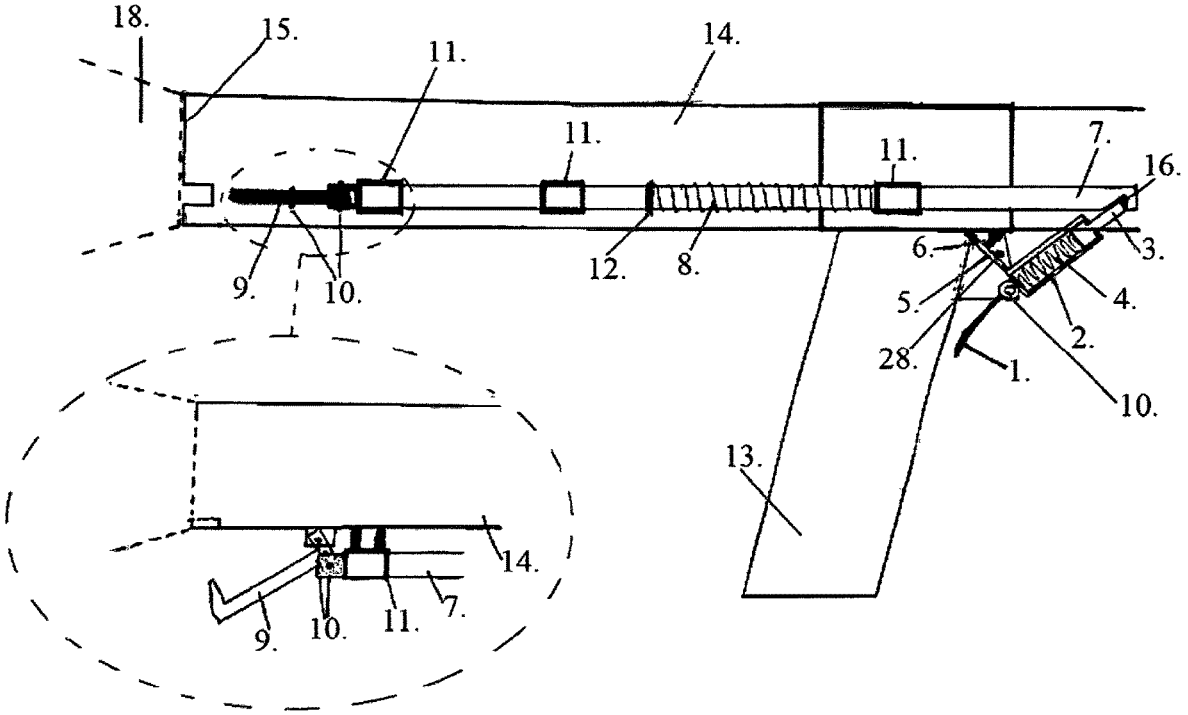

The document contains the following schematics of the invention:

FIG. 1: Weapon in normal state, with all parts at rest,

FIG. 2: immediately after firing,

FIG. 3: firing mechanism in active state, partial top view

Figure 4:
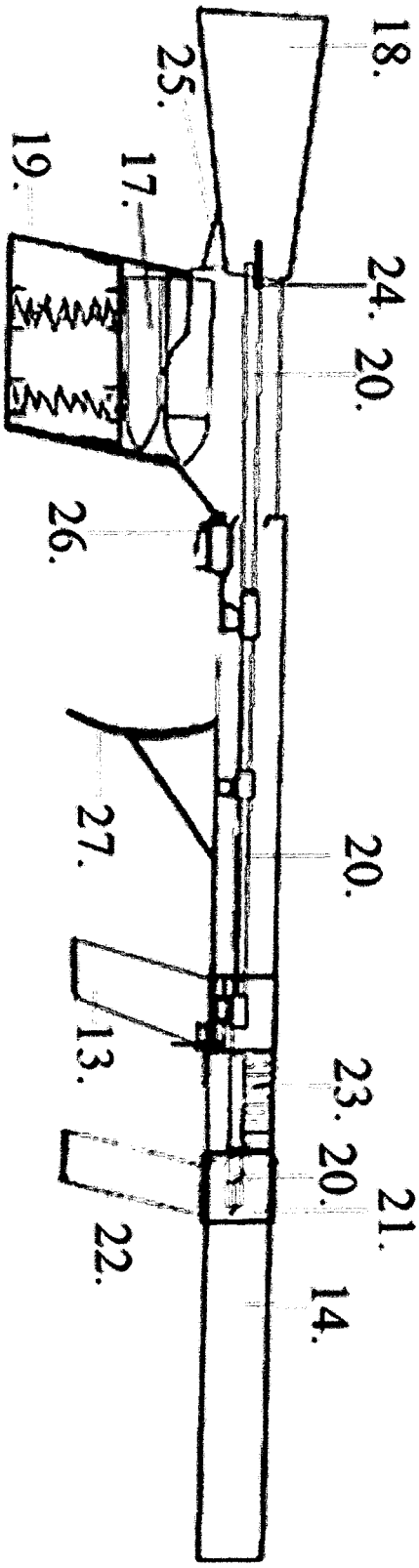
Figure 5:
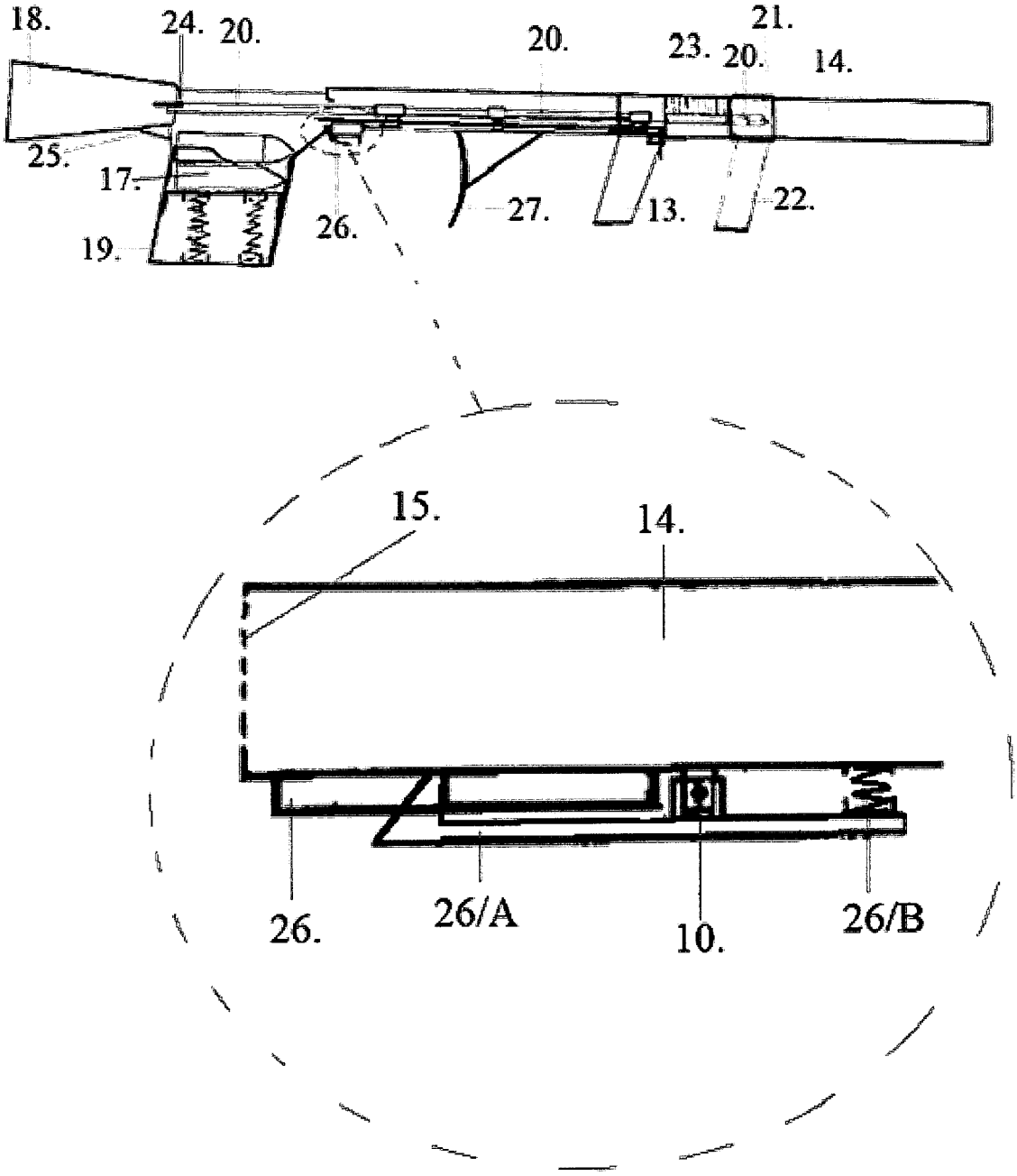
Figure 6:
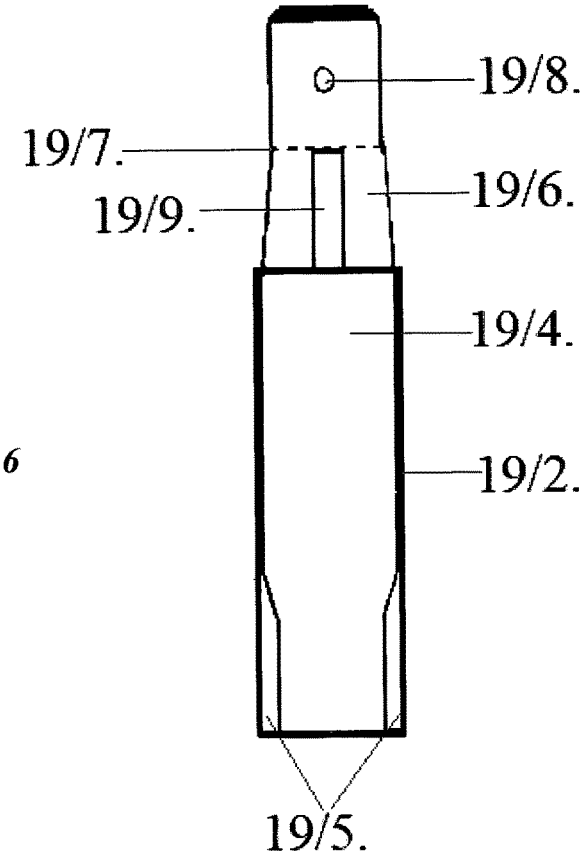

FIG. 4: open position with magazine,

FIG. 5: open position, with a close-up of the magazine well,

FIG. 6: top view of magazine

Figure 7:
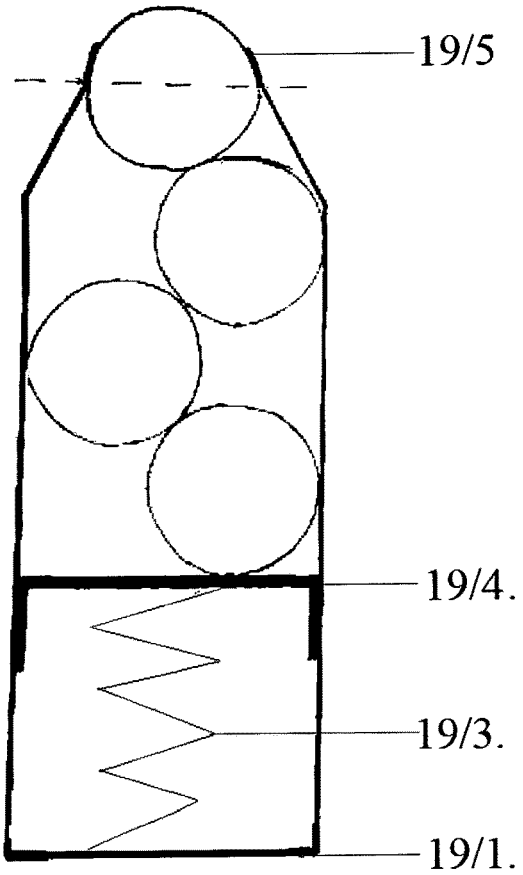
Figure 8:
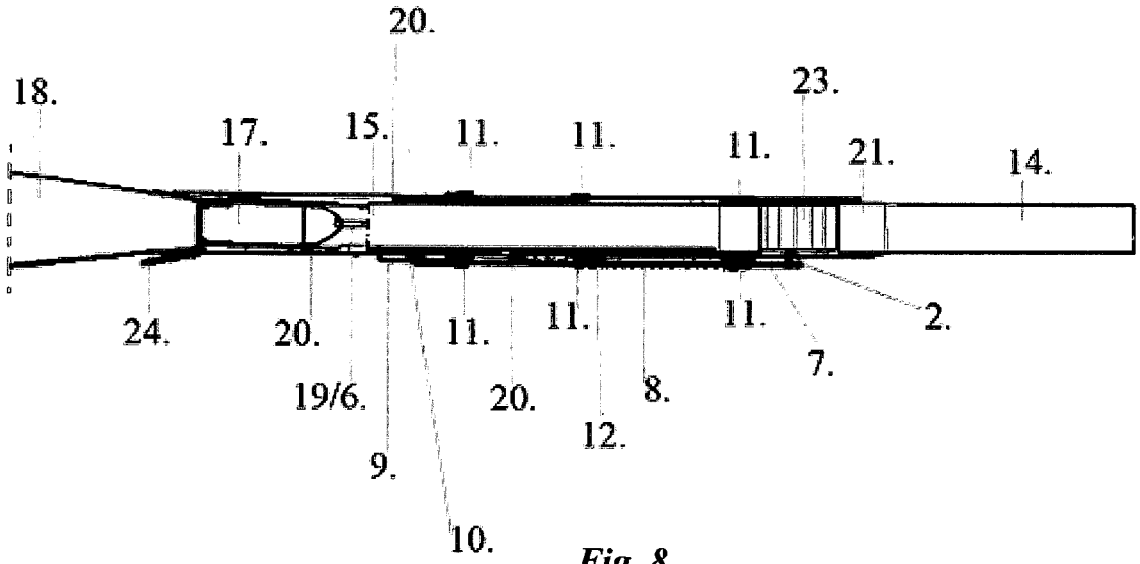
Figure 9:
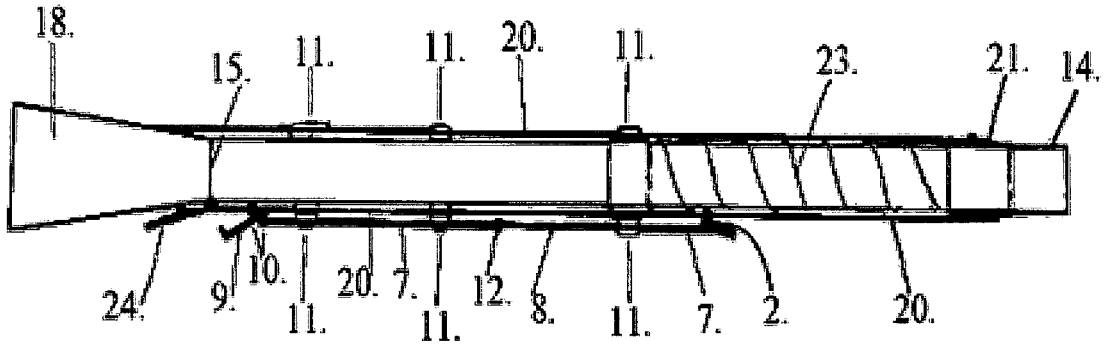
Figure 10:
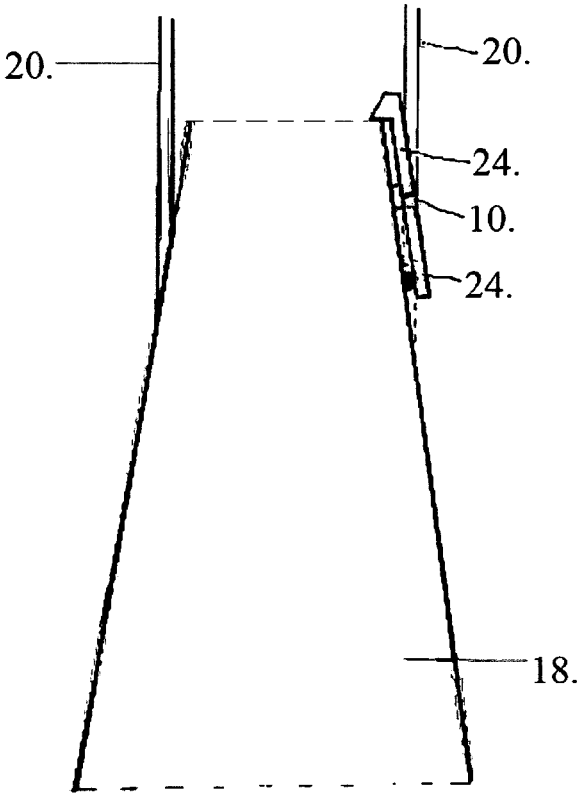

FIG. 7: double row magazine cross-section,

FIG. 8: top view of open position with magazine,

FIG. 9: top view, closed position with hammer pulled back,

FIG. 10: extractor and its tension spring on the funnel, top view.

The Figures show a shoulder-mounted weapon, as is practical for the size of the cartridges in question. The design can be used for many different types of cartridges 17, regardless of caliber and purpose. FIGS. 1 and 2 show the firing mechanism and its operation, as well as the technical details for the recoilless operation. By pulling back the trigger 1, the top hollow pin 2 of the trigger rotates along the fulcrum 10 of the bolt and pulls the hammer pull rod 7 forward by hooking it with the latch pin 3. This makes the hammer 9 turn to the side, and puts tension of the actuator 8 spring of the hammer pull rod. The guide rails 11 for the pull rod ensure the straight-line motion of the hammer pull rod 7. By pulling back the trigger 1, the back pin 5 of the trigger also moves, putting tension on the return spring 6 for the back pin of the trigger. Finally, the latch pin 3 is removed from the latch groove 16 on the hammer pull rod 7. As a result, the actuator spring 8 of the pull rod (which is flush against the stop for the actuator spring 12 of the pull rod) pushes the hammer pull rod 7 backwards, which in turn slams the hammer 9 onto the cartridge primer, thereby completing the firing process. When letting go of the trigger 1, the return spring 6 for the back pin of the trigger pushes the back pin 5 of the trigger, returning the trigger 1 and the top hollow pin 2 of the trigger to their pre-firing position. Meanwhile, due to its rounded tip, the latch pin slides 3 back into the top hollow pin 2 of the trigger, then, having returned to its normal position, slides back into the latch groove 16, with the aid of the return spring 4 of the latch pin. Then, by pulling the trigger 1 again, it is possible to repeat the process. As noted, FIG. 1 shows all parts in their normal state, at rest, while FIG. 2 shows the state of the weapon immediately after firing, with the hammer 9 and the actuator spring 8 for the hammer pull rod in their normal (rest) state, but the trigger 1 not yet having returned to its rest state. When the trigger 1 is released, the return spring 6 for the back pin of the trigger returns it to its normal position.

FIG. 2 shows the state of the weapon immediately after firing, with the hammer 9 and the actuator spring 8 for the hammer pull rod moving said hammer in their normal state, but the trigger 1 not yet having returned to its rest state. FIG. 3 shows the state of the weapon immediately before firing, with the hammer 9, the actuator spring 8 for the hammer pull rod, and the trigger 1 all under tension. The partial top view of FIG. 3 shows the hammer 9 in its previous state (under tension). FIG. 4 shows a side view of the weapon, in open position, along 18 with its magazine 19. In other words, this shows the state of the weapon before chambering. Chambering occurs when the casing of the fired cartridge 17 left in the barrel 14 has been ejected, and a new cartridge 17 is about to be chambered in the barrel 14, or when we just connected the magazine 19 to the weapon and we wish to ready it for firing by chambering a cartridge 17 into the barrel 14. Ejection is as follows: the extractor 24 on the funnel hooks 18 into the rim/groove of the cartridge 17 in the barrel 14. The funnel 18 is connected to the forend 21 by the funnel pull rod 20. After firing, we grasp the front grip 22 of the forend 21, and pull it backwards (towards us). By doing this, as the forend 21 moves backwards, it also pulls the funnel 18 backwards, as it is connected to it by the funnel pull rod 20. As the extractor 24 on the funnel 18 is hooked into the cartridge 17, as it moves backwards, it pulls the fired cartridge 17 from the barrel 14, leaving space for the next cartridges 17. In this state, the funnel 18 and its loading pin 25 move behind the magazine 19, making it possible to chamber the next cartridge 17 from the magazine 19. FIG. 4 shows an open side view of the weapon with a magazine 19 attached, before chambering, its firing mechanism at rest. Chambering 14 happens as follows. The previously ejected, empty cartridge 17 is replaced by a new cartridge 17 loaded into the barrel 14. This is achieved by pushing the fixed front grip 22 attached to the forend 21 forwards. The forend 21 is rigidly connected to the funnel 18 by the funnel pull rod 20, meaning that when the forend 21 is pushed forwards, the funnel 18 also moves forwards at the same speed and distance. As it moves forward, it pushes the cartridge 17 rising from the magazine 19 out of the magazine 19 and into the barrel 14 with its loading pin 25 located at the bottom of the funnel 18. This is assisted by the diagonally upwards oriented section 19/6 of the magazine holding pin, which also acts as a loading guide. The groove in the magazine holding pin 19/6 is the loading pin groove 25. The loading pin 25 on the funnel slides 18 into the loading pin groove 25, allowing the funnel 18 to press against the open breech 15. At this point, the weapon is chambered and closed. Chambering the cartridge 17 into the barrel 14 is assisted by the lock spring 23 located between the fixed grip 13 and the front grip 22, which is primarily for keeping the funnel 18 flush against the open breech 15, and holding the cartridge 17 in place. However, while chambering, it also functions as a recoil spring (as for the AK47 or M4). At this point, the weapon is ready to be fired. This is followed by firing (FIGS. 1; 2; 3), then ejecting the casing, then chambering again. The close-up section of FIG. 5 shows the magazine 26 well on the bottom of the barrel 14. This is what the first, horizontal section of the magazine holding pin 19/6 located on the magazine slides 19 into. The magazine holding button 26/A latched into the locking groove 19/8 is also found here. By pressing on its forward section, the rear section of the magazine holding button 26/A unlatches from the locking groove 19/8, allowing the magazine 19 to be removed or replaced. The tension spring for the magazine holding button 26/A ensures that the magazine holding button 26/A only unlatches from the locking groove 19/8 if it is pushed, so that the magazine 19 will not slip or fall out of the weapon by itself.

Naturally, this weapon also uses a safety 28, which can be a simple manual safety 28. Practically speaking, this is a lever which, when pulled down, braces the back pin 5 of the trigger, preventing the trigger 1 from being pulled and firing the weapon. However, when turned upward, it allows the back pin 5 of the trigger and thus the trigger 1 to move freely, making it possible to fire the weapon. FIGS. 6 and 7 show the magazine. The weapon can use the most common types of magazines 19. The vast majority of the world's weapons industry (including military, police, and self-defense pistols, military rifles, sport rifles, machine pistols, some automatic rifles) use box magazines, as do we. This is due to box magazines being simple, cheap to manufacture, and reliable. Because the cartridges 17 for our weapon are much larger, the magazines 19 themselves are also much larger (in height, width, and depth). The main difference is that we use a magazine holding pin 19/6, because a larger diameter funnel 18 is connected to the barrel 14. It also functions as a feed guide, and its groove (funnel pin groove 19/9) acts as a connection point for the loading pin 25 on the funnel. Double-row (FIG. 7) magazines 19 are also usable, as only the magazine holding pin 19/6 of the magazines 19 touches the weapon, meaning that wider magazines can be used freely. FIG. 10 demonstrates a particularly advantageous design for the extractor 24 described above, with the top view showing the tension spring 24/A for the extractor, located on the funnel. FIG. 8 shows an open top view of the weapon, with a magazine, pre-chambering—with its hammer 9 in its normal rest position. FIG. 9 shows a closed view of the weapon, with its hammer 9 drawn back.

Currently, the advantage of our solution in comparison to existing products and solutions is that the utility model design provides more precise aim. The simple design ensures easy disassembly for the weapon. Relatively few high-precision parts are needed, making the device reliable, simple to operate, and inexpensive to manufacture. Our utility model, ideally used for high-caliber weapons, has a magazine 19, allowing for quick reloading. The design is compatible with a wide variety of cartridge types. We have also reduced the excessive recoil typical of high-caliber ammunition, in addition to making single-person operation feasible by using magazines

| Parts reference |
|---|
| 1. Trigger |
| 2. Top hollow pin of trigger |
| 3. Latch pin |
| 4. Return spring of latch pin |
| 5. Back pin of trigger |
| 6. Return spring for the back pin of the trigger |
| 7. Hammer pull rod |
| 8. Actuator spring for the hammer pull rod |
| 9. Hammer |
| 10. Bolt |
| 11. Guide rails for pull rod |
| 12. Guide rail-mounted stop for the guard rail actuator spring |
| 13. Fixed grip |
| 14. Barrel |
| 15. Open breech |
| 16. Latch groove |
| 17. Cartridge |
| 18. Funnel |
| 19. Magazine |
| 19/1. Magazine well |
| 19/2. Magazine body |
| 19/3. Magazine spring |
| 19/4. Feed block |
| 19/5. Magazine lip |
| 19/6. Magazine holding pin |
| 19/7. Bend in magazine holding pin |
| 19/8. Locking groove |
| 19/9. Funnel pin groove |
| 20. Funnel pull rod |

-continued

| Parts reference |
|---|
| 21. Forend |
| 22. Front grip |
| 23. Lock spring |
| 24. Extractor |
| 24/A Tension spring for extractor |
| 25. Loading pin |
| 26. Magazine well |
| 26/A Magazine holding button |
| 26/B Tension spring for magazine holding button |
| 27. Stock |
| 28. Safety |

The invention claimed is:

1. A recoilless, slideless repeating magazine-fed weapon, comprising a hammer, a hammer pull, a trigger spring and a safety, the weapon having a barrel with an open breech which connects directly to an open, expanding cross-section funnel, the funnel having an extractor on a side; wherein the funnel connects a forend through a funnel pull rod such that the funnel moves with the forend when moved forward or rearward; wherein the extractor moves with the funnel to remove a cartridge from the open breech when moved rearward and a loading pin on the funnel pushes a subsequent cartridge into the breech when the funnel is moved forward, and the weapon having a magazine connected to a magazine well defined at the open breech with a magazine holding pin.

2. The weapon according to claim 1, wherein the loading pin is located at the bottom of the funnel, and a base of the cartridge in the magazine rests against said loading pin.

3. The weapon according to claim 1, wherein the funnel is equipped with the extractor, and the funnel is flush against the open breech.

4. The weapon according to claim 1, wherein the open breech defines two grooves, a bottom groove for the hammer, and a top groove for the extractor.

5. The weapon according to claim 1, wherein the cartridge chambered into the barrel using the forend is held in place by a lock spring, which is located between a rear fixed grip and the forend.

6. The weapon according to claim 1, having a magazine holding pin wherein a front horizontal section of the pin defines a groove into which a magazine holding button is latched.

* * * * *